US006467396B1

(12) United States Patent
Issler

(10) Patent No.: US 6,467,396 B1
(45) Date of Patent: Oct. 22, 2002

(54) LIGHT BOX PISTON

(75) Inventor: Wolfgang Issler, Schwaikheim (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 09/890,225

(22) PCT Filed: Dec. 15, 1999

(86) PCT No.: PCT/DE99/04038

§ 371 (c)(1),
(2), (4) Date: Jul. 27, 2001

(87) PCT Pub. No.: WO00/45038

PCT Pub. Date: Aug. 3, 2000

(30) Foreign Application Priority Data

Jan. 28, 1999 (DE) ..... 199 03 278

(51) Int. Cl.[7] ..... F01B 31/08
(52) U.S. Cl. ..... 92/186; 92/238
(58) Field of Search ..... 92/186, 208, 232, 92/238, 239

(56) References Cited

U.S. PATENT DOCUMENTS 4,274,372 A * 6/1981 Kelm et al. ..... 92/239 X
4,530,312 A * 7/1985 Kanda et al. ..... 92/186 X
4,683,808 A * 8/1987 Wacker et al. ..... 92/238 X
5,299,490 A * 4/1994 Harrer et al. ..... 92/208 X
5,890,416 A * 4/1999 Thieme et al. ..... 92/186 X
6,357,341 B1 * 3/2002 Watanabe et al. ..... 92/238 X

FOREIGN PATENT DOCUMENTS

| | | |
|---|---|---|
| DE | 10 01 862 | 1/1957 |
| DE | 25 48 254 | 5/1977 |
| DE | 36 42 978 | 6/1988 |
| DE | 197 01 085 | 7/1998 |
| DE | 197 03 001 | 8/1998 |
| DE | 197 47 746 | 11/1998 |
| DE | 198 32 091 | 1/1999 |
| EP | 0 050 257 | 4/1982 |
| EP | 0 171 825 | 1/1989 |
| JP | 57-157862 | 9/1982 |
| JP | 64-25446 | 2/1989 |

* cited by examiner

*Primary Examiner*—John E. Ryznic
(74) *Attorney, Agent, or Firm*—Collard & Roe, P.C.

(57) ABSTRACT

The invention aims at reducing the weight of a box piston having a running surface, the width in the pressure side is different from the width of the running surface on the counterpressure side. To this end, the piston has at least one bent channel that is cast using bent sleeves and is located at least partly above the bolt hubs with a tapering cross section extending approximately in the direction of pressure-counterpressure.

5 Claims, 2 Drawing Sheets

LIGHT BOX PISTON

CROSS REFERENCE TO RELATED APPLICATIONS

Application claims priority under 35 U.S.C. §119 of German Application No. 199 03 278.5 filed Jan. 28, 1999. Applicant also claims priority under 35 U.S.C. §120 to PCT/DE99/04038 filed Dec. 15, 1999. The international application under PCT article 21(2) was not published in English.

The invention relates to a light box piston as defined in the introductory parts of claims 1 and 5.

Such a piston is known from JP-U 64-25446. The aim is to make such a piston, which per se already can be referred to as a light piston, even lighter.

Said problem is solved in connection with a piston of the type specified above by the characterizing features of the independent claims 1 and 5. Advantageous developments of the invention are the objects of the dependent claims.

Owing to the cavities located above the bolt hubs, such cavities being produced with the help of bent sleeves, weight is saved without impairing the strength of the hub support. The dissipation of heat for supporting the bolt is influenced at the same time. With a suitable arrangement of cooling oil nozzles, the dissipation of heat from the piston can be enhanced by providing the channel in the form of a passage opening through which the oil is flowing.

The inlet opening produced by the sleeve is in this connection located on the side next to the bolt hubs. Because of the narrower running surface on the counterpressure side, it is possible to arrange the bent sleeve in such a way that it extends approximately perpendicular to the axis of the hub bores (viewed from the top).

For producing the bent channel, it is necessary to later fit conventional casting machines, which permit only linear movements of the components of the cast-iron mold, with devices for swiveling the sleeves. Such devices are swiveling side trains arranged on a circular track, each supporting a bent core part having a tapering cross section.

The tapering is required in order to permit removal of the bent core part from the mold. An angle of about 6° can be selected as the pull-up slant for the core part.

In a production by means of salt cores according to claim 5 instead of sleeves, the pull-up slant can be dispensed with because the salt core usually can be flushed and removed, as it is possible also with cooling channels, i.e. the salt core does not have to be pulled from the cast piston like a sleeve does.

The invention is explained in greater detail in the following with the help of an exemplified embodiment shown in the drawing, in which.

Figure 1:
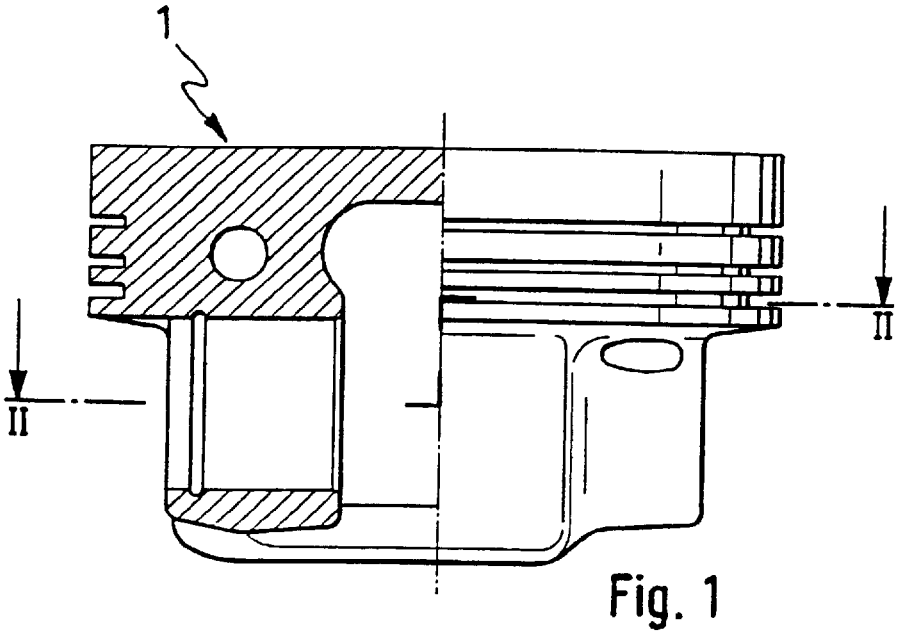
FIG. 1 shows a front view of the piston as defined by the invention, which is cut on the left side.
Figure 2:
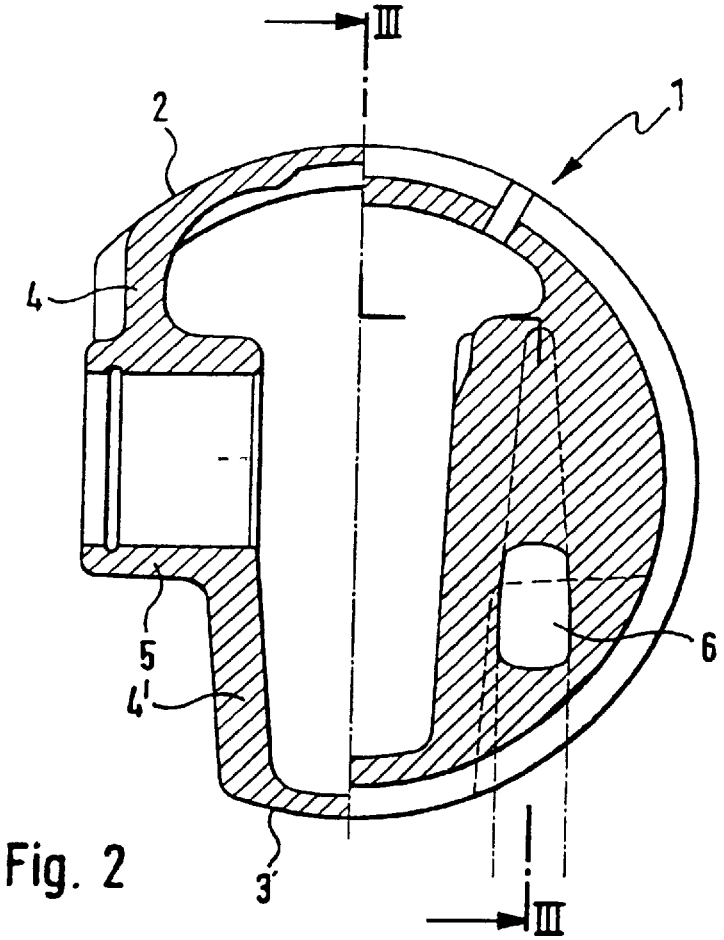
FIG. 2 shows the piston according to FIG. 1 in the sections specified in the latter figure.
Figure 3:
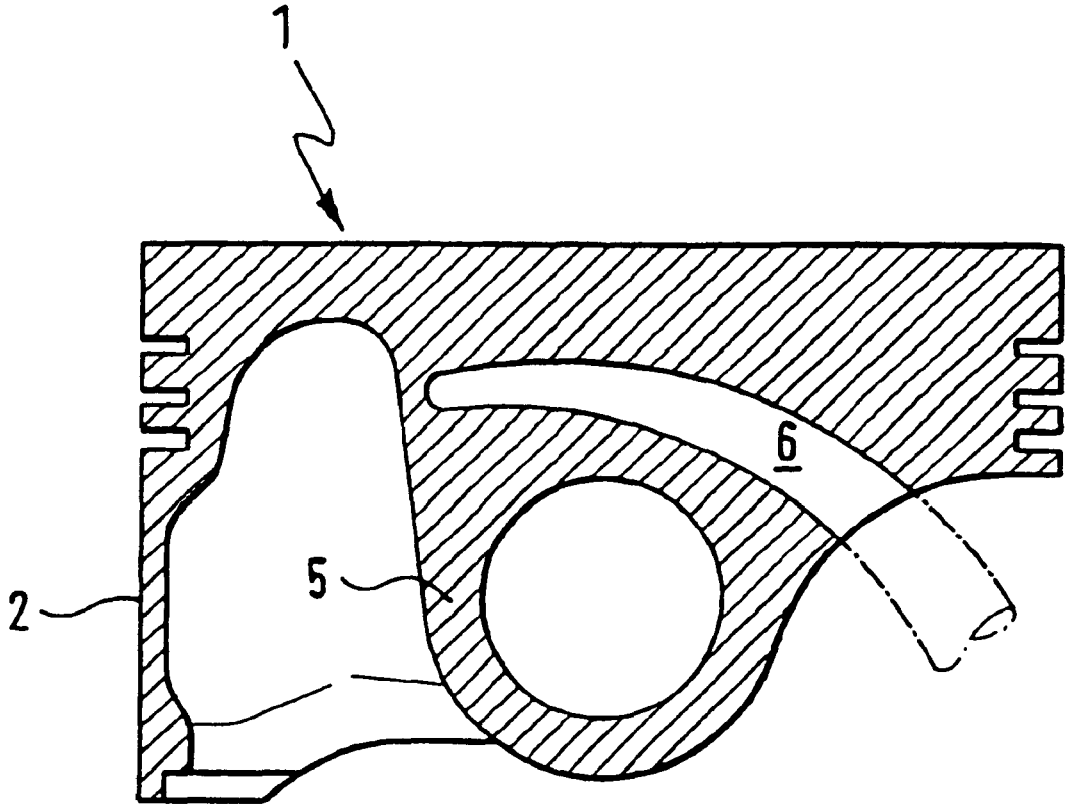
FIG. 3 is a longitudinal section through the piston at the level of the bent sleeve.

A box piston 1 has a running surface 2 on the pressure side, said running surface having a width in the peripheral direction that is greater than the width of the running surface 3 on the counterpressure side.

The connecting walls 4 and 4' extend between the bolt hubs 5 and the running surfaces 2 and 3 in about the direction of pressure-counterpressure. Outside of the connecting wall 4' and inclined next to the hub zenith, a bent channel 6 starts to extend on the counterpressure side, tapering in the direction of the pressure side. Said channel extending approximately in the direction of pressure-counterpressure is for its major part located above the bolt hub.

Said channel 6 may end as a blind hole or it may be extending through.

What is claimed is:

1. A light box piston (1) comprising a running surface (2) on the pressure side and a running surface (3) on the counterpressure side, whereby the width of the running surface on the pressure side (2) is greater than the width of the running surface (3) on the counterpressure side, viewed in the peripheral direction; and whereby the connecting walls (4, 4') extending in about the direction of pressure-counterpressure between the running surfaces (2, 3) and the bolt hubs (5) have, on the pressure side, a greater spacing from the center axis of the piston (1) extending in the pressure-counterpressure direction, than on the counterpressure side, characterized in that the box piston (1) comprises at least one channel (6) at least partly located above the bolt hubs (5), said channel having been produced in terms of casting technology with the use of bent salt cores, and extending in about the pressure-counterpressure direction.

2. A light box piston (1) comprising a running surface (2) on the pressure side and a running surface 3 on the counterpressure side, whereby the width of the running surface on the pressure side (2) is greater than the width of the running surface (3) on the counterpressure side, viewed in the peripheral direction; and whereby the connecting walls (4, 4') extending in about the direction of pressure-counterpressure between the running surfaces (2, 3) and the bolt hubs (5) have, on the pressure side, a greater spacing from the center axis of the piston (1) extending in the pressure-counterpressure direction, than on the counterpressure side, characterized in that the box piston comprises at least one bent channel (6) produced in terms of casting technology with the use of bent sleeves, said bent channel being at least partly located above the bolt hubs (5) and extending approximately in the direction of pressure-counterpressure, and having a tapering cross section with its greatest cross section being located on the counterpressure side, viewed from the axis of the bolt.

3. The light box piston according to claim 2, characterized in that the channel (6) is realized in the form of a through extending passage opening.

4. The light box piston according to claim 3, characterized in that the channel (6) produced in terms of casting technology as a blind hole, is formed by machining as a passage opening.

5. The light box piston according to claim 3, characterized in that the channel (6) is realized as an oil-conducting channel for the purpose of cooling the piston.

* * * * *